United States Patent [19]

Misch et al.

[11] Patent Number: 4,478,183

[45] Date of Patent: Oct. 23, 1984

[54] IDLING SPEED CONTROL FOR INTERNAL COMBUSTION ENGINES

[75] Inventors: Wolfgang Misch, Wiehl; Adolf Freytag, Neuss; Manfred Henning, Kaarst, all of Fed. Rep. of Germany

[73] Assignee: Robert Bosch GmbH, Stuttgart, Fed. Rep. of Germany

[21] Appl. No.: 436,399

[22] Filed: Oct. 25, 1982

[30] Foreign Application Priority Data

Oct. 26, 1981 [DE] Fed. Rep. of Germany ..... 3142360

[51] Int. Cl.[3] ..... F02M 3/00

[52] U.S. Cl. ..... 123/339

[58] Field of Search ..... 123/339, 351, 352, 353, 123/354, 355, 356; 180/176, 179

[56] References Cited

U.S. PATENT DOCUMENTS

| | | | |
|---|---|---|---|
| 4,275,691 | 6/1981 | Wolff et al. | 123/351 |
| 4,352,404 | 10/1982 | Stier | 180/179 |
| 4,363,303 | 12/1982 | Takayama | 123/339 |
| 4,383,510 | 5/1983 | Nakamura et al. | 123/352 |

*Primary Examiner*—Parshotam S. Lall
*Assistant Examiner*—W. R. Wolfe
*Attorney, Agent, or Firm*—Frishauf, Holtz, Goodman & Woodward

[57] ABSTRACT

A first error signal produced by comparison of actual engine speed value with a reference speed value is modified by blocking out of it a component corresponding to speed deviation within a dead zone speed range. The modified signal is then processed separately by proportional and integrating amplifiers of a PI controller each having a characteristic unsymmetrical with respect to the sign of the error signal. Before processing by the integrating amplifier, the modified error signal is further altered by a contribution from a signal proportional to engine speed to compensate for drifts caused by gradual temperature or atmospheric pressure changes. When the engine is not in idling operation, a fedback contribution is supplied at the same place for preloading the integrator for the next idling operation. The separately processed signals are added together to produce a position reference signal for a displaceable idling speed stop for the engine throttle. A final error signal for control of the displaceable stop is obtained by comparing the position of the reference signal with a signal representing actual stop position. When the throttle is actuated by the driver and engine speed rises out of the drive range, the proportional amplifier is blocked and also the stop displacing mechanism, but an addition is made to the stop position reference signal by which the stop controller causes the stop to set a gap between it and the throttle preventing the throttle switch from returning to idling position until another speed comparison showing exit from the drive condition releases the idling speed control.

13 Claims, 1 Drawing Figure

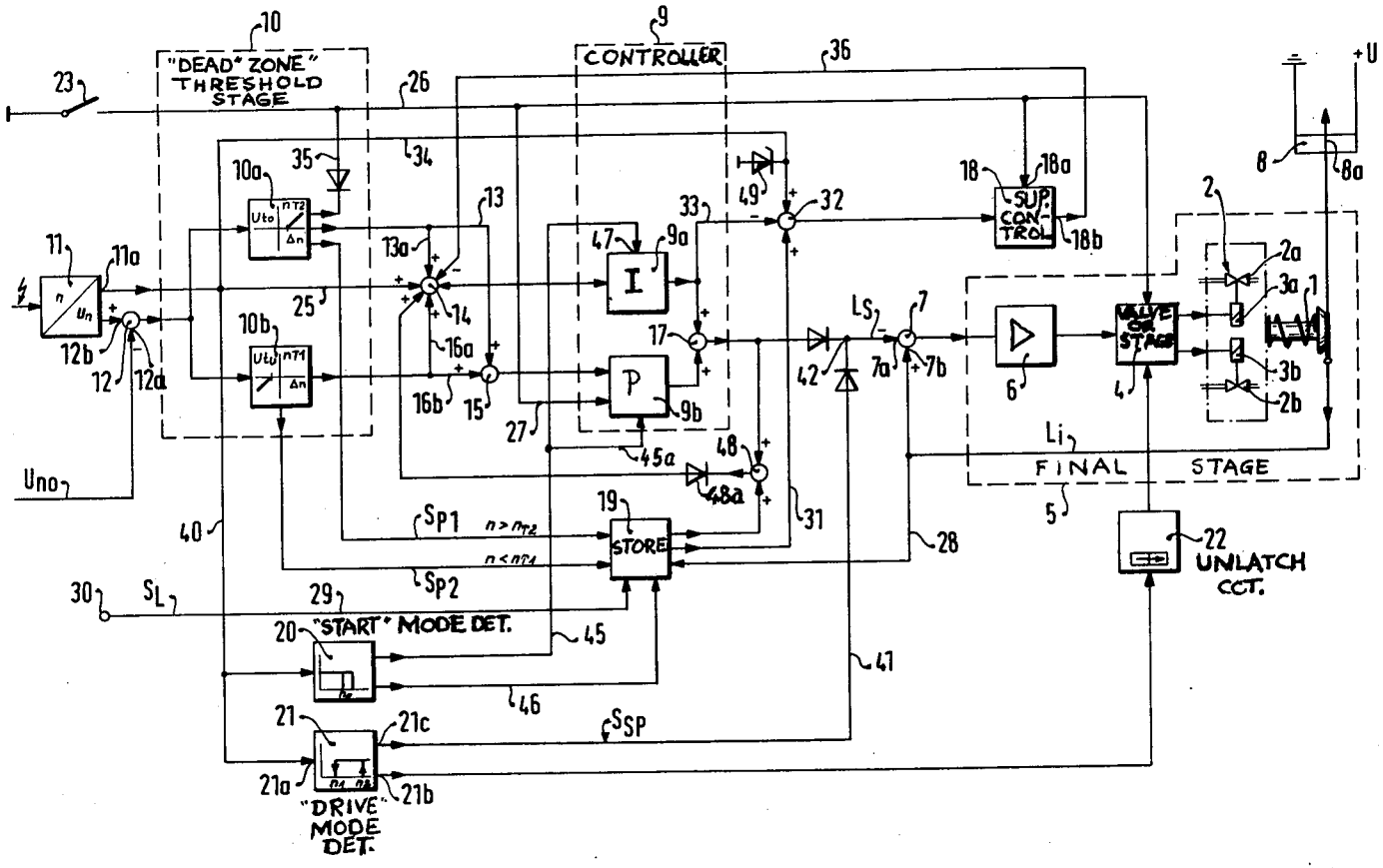
+U
8a
8
2a
3a
3b
2b
2
STAGE
FINAL
5
4
VALVE OR STAGE
22
UNLATCH CCT.
6
Li
18a
18b
SUP. CONTROL
18
7
7b
7a
Ls
28
41
42
32
31
49
48
48a
33
9a
9b
17
45a
CONTROLLER
9
I
P
47
19
STORE
Ssp
45
46
27
13
14
15
16a
16b
13a
Sp1
Sp2
n>n2
n<n2
26
34
35
25
29
"START" MODE DET.
20
21c
21b
21
21a
"DRIVE" MODE DET.
10
"DEAD" ZONE" THRESHOLD STAGE
10a
10b
40
Sl
30
11a
12a
12
12b
11
23
Uno

IDLING SPEED CONTROL FOR INTERNAL COMBUSTION ENGINES

This invention concerns methods and apparatus for control of the idling speed of the engine of a motor vehicle, including regulation of engine speed in the idling mode of the engine and some other actions in other operation modes of the engine for improved transition into the idling speed mode.

Known devices for vehicle engine idling speed regulation are described, for example, in German published patent applications (OS) Nos. 2 049 669 and 2 546 076. In the first-mentioned of these disclosures a speed-responsive electric circuit acts on an electromagnetically actuatable positioning member which controls the cross-section of a bypass channel parallel for the throttle. In this known device control exclusively of the intake air quantity could be problematic, since in this manner it is evidently not possible to take into comprehensive account all the significant magnitudes influencing engine behavior. In particular, it is not possible to influence actively the position of the throttle and thus to produce an effective change of the fuel-air mixture intake.

The system described in DE-OS No. 2 546 076 for idling speed control operates on a throttle disposed in the intake pipe of the engine. A reference value transducer and an actual value transducer for engine speed values are provided and their outputs are supplied to the two inputs of a differential amplifier. An output error signal is supplied to a positioning member operated as a solonoid. The positioning member is continuously connected to the throttle and shifts the throttle in accordance with the error signal. This circuit, like the one previously mentioned, is not capable of introducing boundary conditions into the regulation process and thereby assuring under all conditions that the idling speed of an internal combustion engine remains within a prescribed region even when rapidly acting transition conditions must be dealt with. In particular the known circuits are not suitable for bringing into play and also for influencing drive operation, for example, for fuel-saving drive limiting.

The present invention is related to the invention of a copending patent application, Ser. No. 435,642, filed Oct. 21, 1982, claiming the same priority date as this application and owned by the same Assignees (jointly). The disclosure of that copending application is hereby incorporated by reference.

THE INVENTION

It is an object of the present invention to provide a comprehensive idling speed control for a vehicle engine of the internal combustion type which can take account of previous operation of the engine at the beginning of idling and also of external factors influencing engine behavior.

Briefly, a first error signal, produced by comparison of actual engine speed value with a reference speed value, is modified by blocking out of it a component corresponding to speed deviation within a dead zone speed range substantially centered on the reference speed value. The modified signal is then processed separately by proportional and integrating amplifiers of a PI controller, each having a characteristic unsymmetrical with respect to the sign of the error signal. Before processing by the integrating amplifier, the modified error signal is further altered by a contribution from a signal proportional to engine speed to compensate for drift caused by gradual temperature or atmospheric pressure changes. Preferably a fed back contribution is supplied at the same place when the engine is not in idling operation. The separately processed signals are added together to produce a position reference signal for a displaceable idling speed stop for the engine throttle. This reference signal is also subject to an additional contribution during a non-idling mode of the engine. A final error signal for control of the displaceable stop for the throttle is obtained by comparing the position reference signal with a signal representing actual position of the displaceable stop.

The system has provisions for recognizing start conditions (low speed range) and performing initializing operations in response to such recognition, and for a throttle switch to identify termination of the idling mode, as well as means to store the last idling position of the displaceable stop for a future return to the idling mode, as well as for a contribution to the fed back contribution to the integrating amplifier of the controller during non-idling operation of the engine or during temporary over-speed idling.

A pair of speed thresholds with a hysteresis gap are preferably used to define transitions between idling and non-idling driving ("drive"). Entering a drive phase adds a "drive priority" contribution to the reference positioning signal that brings the idling stop forward but sets a spacing that prevents actuation of the throttle switch by release of throttle until leaving the drive phase produces a signal, which, interrupts the blocking of the pneumatic valves by the throttle switch for a time interval long enough for the disappearance of the drive priority signal to allow the throttle switch to operate.

It is possible to take account of engine temperature effect by modifying reference value signals or controller parameters.

THE DRAWING

The invention is further described by way of illustrative example with reference to the annexed drawing, the single FIGURE of which is a circuit block diagram of an embodiment of the system of the invention by which the method of the invention may be practiced.

DESCRIPTION OF THE ILLUSTRATED EMBODIMENT

The system of the invention for comprehensive control of a vehicular engine in the near-idling speed range or in idling operation, with supplementary provisions for operation of the engine in the drive mode, operates straightforwardly. Therefore, in the simplest construction of such a system, a controllably displaceable positioning member 2 displaces a push rod 1 serving as a displaceable stop for a throttle control mechanism (not shown in the FIGURE) located in the engine intake, so that speed regulation and control by the system of the invention is obtained by adjusting the effectiveness of the intake suction of the engine. In such an arrangement, it is essential that the push rod 1 of the positioning device should simply bear against throttle lever (likewise not shown) actuatable by the push rod. This means that the push rod 1 by bearing more heavily against the throttle mechanism or by retraction of its position can actually open the throttle wider or shut it down to an extreme position determined by a fixed mechanical stop in idling operation of the engine. On the other hand, the vehicle driver (or perhaps a cruise control or the like) can actuate the throttle mechanism to remove it or keep it off the push rod 1 and set it at some other desired position. For this reason, the push rod 1 is hereinafter referred to as a displaceable stop, because for idling the throttle mechanism stops there when the accelerator pedal is released.

The positioning device 2 shown in the drawing displaces the stop 1 and preferably operates as an electro-pneumatic device, utilizing an air inlet valve for pushing against the throttle mechanism (opening the throttle) and an evacuation valve for retraction of the stop 1 (permitting closing down of the throttle). The valves are respectively designated 2*a* and 2*b* in the drawing. They are respectively actuated by the relays 3*a* and 3*b* which are suitably energized by a valve-operating electrical stage 4 in response to corresponding electric signals. The final stage 5 outlined in broken lines includes not only the valve-operating stage 4, but also, in the illustrated case, a positioning controller stage 6 which drives the stage 4 and responds to the output of a comparison stage 7 where a reference value signal supplied at 7*a* is compared with a signal supplied at 7*b* representing the actual position of the stop 1 and hence also representing the throttle position when the throttle mechanism abuts the stop 1. A potentiometer 8 has its tap arm 8*a* driven by the stop push rod 1 of the positioning device 2 and thus directly produces an electric output signal representing the actual position of the stop 1, the signal being designated $L_i$. The controller 6 in the simplest case can be simply an amplifier to supply an output with a suitable range of voltage variation.

The reference value provided at 7*a* for comparison with the signal $L_s$ is obtained by a controller amplifier 9 that is preferably of a non-linear type and which has inputs derived from the dead zone threshold circuit 10 defining a range of variation of idling speed permissible without correction.

Disregarding for the moment certain peripheral circuits that will be explained later located at the bottom of the FIGURE, there is a direct path starting from the converter circuit 11 that produces a voltage proportional to speed in response to spark pulses from the engine or the like. A speed comparison circuit 12 where the voltage proportional to speed $U_n$ is provided at 12*b* for comparison with a reference speed value voltage $U_{no}$ provided at 12*d* produces a speed error signal for a dead zone stage 10, followed by summing stages 14 and 15, a controller stage 9 yet to be described, a final comparison stage 7 and a final controller and positioning unit 5.

The dead zone stage 10 is so designed that outputs are provided only if the error signal from the comparison stage 12 exceeds a certain absolute magnitude, which is to say when one of two thresholds symmetrically disposed on both sides of the reference speed value $U_{no}$ are crossed. The dead zone so defined is only slightly greater than the range of natural fluctuations of the engine idling speed.

As shown, the dead zone circuit 10 comprises two circuit blocks 10*a* and 10*b*, both supplied with the error signal from the comparison circuit 12. The circuit block 10*a* is so constituted that as symbolically shown in the drawing, an output signal $U_{to}$, for example a positive output signal, is produced when the aforesaid error signal oversteps an upper dead zone limit speed $n_{T2}$. The output signal $U_{to}$ may be proportional to the speed deviation or have any other dependence on the speed deviation. It is supplied over a connection 13*a* to a summing stage 14 serving the integral portion of the controller 9 and over the connection 13*b* to a summing stage 15 serving the proportional component circuits of the controller 9. Corresponding functions are performed and outputs are provided in the lower block 10*b* of the dead zone circuit. When a lower speed threshold $n_{T1}$ is understepped, the block 10*b* generates an output voltage $U_{tu}$, in the illustrated case a negative output voltage, for example. This voltage again may be proportional to the speed deviation or have some other relation thereto, and it is supplied over the connections 16*a* and 16*b* respectively to the summing stages 14 and 15.

The summing stage 15 for the proportional component input of the controller 9 is supplied to a proportional amplifer 9*b* of the controller. As already mentioned, the controller is preferably a non-linear or unsymmetrically operating controller. The summing stage 14 provides an input for an integrating amplifier 9*a*. The outputs of the integrating amplifier and of the proportional amplifier are supplied to another summing stage 17 for producing the signal $L_s$ that serves as the reference position value for comparison with the actual position value $L_i$ in the summing stage or comparator 7.

In connection with the description of the operation of the system of the invention, more will be said about still other signals supplied to the individual summing stages and amplifiers. Another circuit block that should be mentioned at this point is a control circuit 18 that provides a speed-dependent control signal only for the integral portion of the controller 9, particularly for the case when the engine speed is above the upper dead zone speed boundary $n_{T2}$ and the throttle is open.

There is also provided a storage circuit 19 for storing the actual position value signal $L_i$, a circuit 20 for start-up recognition, a circuit 21 for recognition of drive operation and a circuit 22 which performs a so-called unlocking of drive and assures that in the transition from drive to idling modes of operation a supplementary time function will smoothly lead to the restoration of normal idling speed regulation. Finally, mention must be made of the throttle switch 23 which is always closed when the displaceable stop 1 abuts the portion of the throttle mechanism which it can operate by displacement, for example a throttle lever already mentioned in previous description. The basic course of operation of the system of the invention for engine speed control is reinforced in further development by boundary and transition conditions, for example behavior under partial load and in drive operation will now be described. The basic regulation operation is so constituted that the intake condition of the engine is modified on the basis of the constitution of the controller 9 and its components for producing the reference value for the displaceable stop position for the throttle and then by the throttle itself in so far as it is actuated by the displaceable stop.

For this purpose, the non-linear controller amplifier 9 produces:

First, a rescue function which is effective outside of the dead zone when the actual speed understeps the reference idling speed $n < n_{ref}$, and Secondly, a pull-down function that is effective outside of the dead zone when the actual engine speed oversteps the reference idling speed ($n > n_{ref}$), with limiting of the control range to $n > n_{min}$ in any case.

The rescue function thus comes into play if on account of an insufficient engine speed, lying beyond the dead zone, the engine threatens to stall. The pull-down function becomes effective if the speed rises higher than the boundary speed $n_{T2}$ and must be brought back to the idling speed.

The non-linear controller amplifier 9 operates with reference to the rescue function by means not only of integral and proportional components, but also in the most preferable case, a differential component, whereas the pull-down function is represented in terms of proportional and/or integral components. The formation of the proportional component is performed by the proportional amplifier 9b. The integrator or integrating amplifier 9a is provided for formation of the integral component. As already mentioned, the summing stages 14 and 15 respectively precede the amplifiers 9a and 9b and are provided with the input data necessary for the subsequent formation of the rescue and pull-down functions. In order to produce the differential component of the rescue function, the proportional amplifier can operate with derivative action, such as is used to provide lead in so-called "aided" target-tracking. It is also possible to weight the individual signals supplied to the proportional amplifier, for example by taking a greater value for the steepness of the curve which results in the understepping of the lower dead point speed boundary in the circuit block 10b, so that when the proportional amplifier 9b initially reacts superproportionally, the rescue function assuredly comes into play, and the throttle is immediately opened wider.

An advantageous elaboration of the invention provides that although a dead zone is provided as already described, nevertheless a basic integral component also exerts a range of effect within the dead zone in such a way that engine speed drifts resulting from long-term influences, such as those of temperature and atmospheric pressure, are eliminated, and the operating point can always be reliably centered in the dead zone. For this purpose, an output 11a of the engine speed signal generator 11 is provided at which there is available a voltage value proportional to the actual engine speed. A connection 25 connects the output 11a directly, thus bypassing the dead zone circuit 10, to the summing stage 14 that provides the input for the integral portion of the controller 9, so that there is also an effect within the dead zone range from the integrator side of the controller 9. It is hardly necessary in this connection to mention further that the integral component essentially represents the throttle position.

When the engine is not in idling operation, as indicated by an open throttle switch 23, the speed regulation described above for the idling or near-idling speed range is discontinued, and a speed-dependent position and/or integrator control is carried out in connection with the throttle switch 23 for recognition of the operating condition. It is to be understood that the throttle switch can be constituted as an electrical, electronic or electro-mechanical device. By speed and/or integrator control is meant that the throttle position and/or the integral component above mentioned which substantially represents the throttle position, is carried forth according to a predetermined function which, for example can be defined by the relation between throttle position and engine speed for the particular engine.

The discontinuance of speed regulation is produced by the throttle switch 23 over a connection 26 which supplies an inhibit signal to the valve operating stage 4 when the throttle is open. This blocking signal is also supplied at the same time by the line 27 (connected to the line 26) over to a corresponding inhibit input of the proportional amplifier 9b of the controller amplifier 9, so that the proportional component is switched out and only the integral component is maintained through a special manner of control when the engine is not idling.

The storage circuit 19 is supplied with the actual position signal $L_i$ of the displaceable stop 1 over the connection 28. It also receives inhibit or blocking signals $S_{p1}$ and $S_{p2}$ respectively from the circuit blocks 10a and 10b whenever the actual engine speed moves out of the dead zone defined by those circuit blocks, thus for $n > n_{T2}$ and $n < n_{T2}$. Another input line 9 to the store 19 brings a load-recognition blocking signal $S_L$, from the terminal 20, which can for example originate in a tachogenerator not shown in the drawing, for the purpose of preventing the store 19 to accept the actual position signal $L_i$ when the engine is operating under load. The content of the store 19 is treated as representing the idling speed operating point and is supplied over a connection 31 to a comparison stage 32 to which the output of the integrating amplifier 9a is supplied for comparison over the line 33.

The comparison stage 32 is also supplied a signal proportional to actual engine speed from the output 11a of the speed signal generator 11 during speed-dependent integrator control operation, so that the control circuit 18, to which the output of the summing comparator stage 32 is supplied, can operate effectively in dependence upon engine speed. During idling speed regulation, the control circuit 18 is blocked (inhibited) by a signal at its input 18a grounding that input over the line 26, but when the throttle switch 23 opens, this inhibit signal is removed and the control circuit 18 is enabled, provided that at the same time over the line 35 branching off the line 26 it is recognized that the actual engine speed is greater than the upper dead zone limit (n greater than $n_{T2}$). When the control circuit 18 is thus enabled, there is provided at its output 18b a control signal that makes a contribution to the summing stage 14 which supplies the input of the integrating amplifier 9a. This is a control signal for the integral component therein produced and/or the PI sum produced in the comparison stage 17 and used as the reference position signal $L_S$ for the displaceable stop 1.

In consequence, when the engine speed, operating with open throttle, leaves the dead zone, the integrator content for load-free (idling) operating condition is stored, then the engine speed deviation from a reference value is measured and is evaluated in circuit 18 by the gradient of the throttle-opening-to-engine-speed characteristic, and the resulting value is added to the integrator content to produce a reference position signal from which a position regulating magnitude is obtained and supplied to the position controller 6. The position controller 6 also receives, by connections not shown in the drawing, a control signal when the final valve operating stage is blocked, which assures that when the open throttle is allowed to go back out of the partial load region into the idling position, a defined positioning operation will take place.

In the simplest case, without drive positioning, regarding which an explanation will next be made, the actual position value of the stop positioning device 2 where it was arrested when the engine speed went out of the dead zone, can be brought into play. This procedure has the advantage that the variable parameter of the control path can be automatically corrected. In deviation herefrom, it is also possible, in going back out of the partial load operating mode, which is identified by an open throttle switch 23 and the condition $n > n_2$ ($n_2$ being the upper engine speed threshold), over into the idling mode and thus back into speed control, the stop 1 of the positioning device 2 will, during an adjustable time, be controlled in the idling speed position. This adjustable time lapse will at the latest terminate when the engine speed is smaller than or equal to the upper dead zone speed boundary ($n \leqq n_2$). A preferred course of operation regarding the operation of the engine in partial load and idling modes can run in such a manner that first, upon transition out of idling into partial load with opening of the throttle, a blocking signal is supplied to the final valve operating stage. This does not however take effect without some selectivity, but rather this blocking signal itself or components activated by it assure that in this case (with open throttle switch) the displaceable stop 1 will be held fast in the last position it had before the opening of the throttle switch.

The opened throttle switch in the above-described transition puts into operation the control of the integrator dependent upon engine speed, in other words, in normal driving operation the integrator of the integrating amplifier is, so to say, pre-loaded, this being possible to the extent that it also has an operating range portion that can be designated as a variable store. If then the transition into idling operation follows, the pull-down function then comes into play and the displaceable stop 1 is first moved out in order to pick up and make secure the throttle position according to the desired program of the pull-down function that is provided, so that the motor will not hesitate or stall because of abrupt closing of the throttle. Here, as may be recognized, the problems of drive operation are touched regarding which further discussion will presently follow. It should however be further noted for better understanding of the invention that there are a multiplicity of possibilities for constituting the pull-down function, and correspondingly the rescue function, of the main regulation path by different kinds of evaluation of the signals supplied to the controller amplifier 9, by corresponding asymmetric and therefore non-linear design of the controller characteristics. Thus, the pull-down function can be made to produce first a pushing out of the stop 1 as the result of "pre-loading" of the integrator, with a transition into the idling speed position exclusively by operation of the integrating amplifier 9*a*, which is to say, in this case, while the proportional amplifier 9*b* is switched off or has its output to the summing stage 17 interrupted.

On the other hand, within the frame of the present invention is the feature of basing the above-mentioned rescue function particularly strongly on the proportional amplifier and to provide a substantially stronger P component, so that the controller 9 as a whole strongly takes hold at speeds below the dead zone boundary speed $n_{71}$, whereas when the engine speed oversteps the upper dead zone boundary speed $n_{72}$, the circuit operates normally with otherwise evaluated proportional and integral components of the controller 9. It is therefore a particular characteristic of the present invention that the controller 9 can operate unsymmetrically and thus make optimum fit to the operating behavior of the engine.

In normal operation of a motor vehicle, there are very often longer or shorter drive phases, for example when going downhill, when the throttle is suddenly let up at high speeds (which occurs for example when going around curves) or generally in the transition from partial load operation into idling, when, for example, the vehicle rolls toward a patch of cobble stones or the like. A circuit block 21 is provided to operate for recognition of the drive mode of operation which is generally referred to hereinafter merely as a drive comparator, to which the engine speed signal from the output 11*a* of the engine speed signal generator 11 is supplied as an input for determination when the engine speed oversteps and understeps particular speed thresholds. The input signal can be obtained a number of ways otherwise than in the manner in the illustrated example where its connection is shown by the line 20 to the input 21*a* of the drive comparator. Switching hysteresis is provided for this operation mode boundary recognition, so that the drive comparator produces a signal at its output 21*b* when a higher speed threshold $n_2$ is overstepped, and a signal at its output 21*c* when a lower speed threshold $n_1$ is understepped. The drive comparator 21 is designed to provide a drive positioning signal $S_{sp}$ at its output 21*c* for supply over the connection 41 to a summing stage represented by the junction 42 for contribution to the signal $L_s$ utilized as a position reference signal for comparison with the actual stop position signal $L_i$ in the comparator 7 which furnishes the final error signal to the position controller 6. This contribution to the signal $L_S$ can be evaluated as signifying "priority for drive position". In other words, when the drive comparator has detected a drive phase in the operation of the engine, what happens is simply that this additional signal is brought into play, either as shown as a contribution to the reference position signal $L_S$ or, what is equivalent, as a separate addition biassing the comparator 7. The drive positioning signal is so constituted that when the drive mode speed threshold is overstepped, the displaceable stop 1 is positioned in a drive position such that the throttle can stick against a mechanical drive stop, for example a mechanical 3° drive stop, and to do this for such a time as may elapse until the engine speed goes down far enough to understep the drive boundary speed $n_1$. This drive positioning signal providing priority for the drive position supplied to the position control circuits can be generated and applied whenever the engine speed has previously overstepped the value $n_2$ and thereafter remains continuously greater than $n_1$.

Preferably the relations between the positioning of the throttle, the state of the throttle switch and the positioning of the displaceable stop 1 are such after a "drive" phase has come into operation in the operation of a vehicle and the driver takes his foot off the accelerator pedal and the throttle is thereby mechanically closed, a gap between the stop 1 and the throttle lever remains that for example can be about 0.5 mm wide, so that the throttle switch 23 remains open. It should not be overlooked that with the throttle switch thus opened, the final valve operating stage 4 will not be activated through the controller 6 because of the blocking signal from the throttle switch, so that it is necessary when the speed drops out of the "drive" range (n smaller than $n_1$) to activate the final valve operating stage 4. For this purpose, the drive-unlock circuit 22 is provided that after every "drive" phase response to a signal from the output 21*b* of the drive comparator when that signal appears in order to activate or enable the operation of the final valve operating stage 4, so that it becomes possible to displace the stop 1 out of its drive position by means of the electropneumatic positioning device.

The drive-unlock circuit 22 is provided with a time function which switches the final valve operating stages into active condition for a predetermined time interval ($t_M$) at the end of a drive phase, until the displacement path or rest gap of 0.5 mm (in the example given) between the stop 1 and the throttle lever has been travelled, to close the throttle switch 23. In such case, the blocking signal exerted on the final valve operating stage 4 then disappears and speed regulation can again come into effect, which can happen only as the result of this supplemental time function of the drive-unlock circuit 22.

The drive comparator 21 together with the drive-unlock unit 22 thus make possible a position controlled drive position of the displaceable stop 1. The positioning can also be performed through an integrated limit switch in series with the evacuation valve. Upon termination of the drive phase (understepping of the drive mode boundary $n_1$), the drive positioning signal is immediately removed from the summing stage 42, the priority for this signal is extinguished and the already mentioned pull-down function can take effect, so that the stop 1 is moved out of this drive position (for example, 1 mm position) in the direction of the operating point (the 0.5 mm gap is hereby closed) and the throttle switch 23 switches regulation back in and enables the final valve operating stage 4 after the running out of the time function of the drive-unlock circuit 22. The pull-down function of regulation then brings the speed back to the reference idling speed.

Alternately, the pull-down function for smooth transition in engine speed to the idling speed after drive phases can be so constituted that when the engine speed drops out of the drive range, the displaceable stop 1 first is put into a raised position compared with the idling speed operating point. For this purpose, the drive comparator can be so constituted that the drive positioning signal is incremented when the engine speed understeps the lower drive range speed boundary which takes effect on the stop 1 through the position controller 6 and the final valve operating stage 4, and then goes back according to a time function. This positioning at a raised position then terminates in the running out of the time function first at a positioning at the idling speed operating point and finally after the running of another time function ends in a transition into regulation. The last-named time function will however be prematurely terminated if the actual speed runs through the upper boundary $n_{T2}$ of the dead zone.

Still another threshold switch, shown in the drawings as the start recognition circuit 20, serves for setting the content of the integrator that forms part of the integrating amplifier and forces a predetermined initial condition of the integrator at speeds in the neighborhood of the starting speed. The start recognition circuit 20 also receives a speed signal from the speed signal generator 11 that provides signals for idling speed regulation. This speed signal is provided over the connection 40. The circuit 20 has outputs 45 and 46 at which it produces signals during a time interval over which the engine speed lies below a prescribed starting threshold $n_0$ ($n \geqq n_0$). The line 45 goes to the integrating amplifier **9*a* and has a branch 45*a* going to the proportional amplifier 9*b***.

In the starting mode the signal proceeds over the line 45 from the start recognition circuit 20 to an input 47 of the integral amplifier **9*a* which produces an integrator setting for initial positioning. At the same time the position value store 19 is set by the start recognition circuit 20 to a suitable initial value (initializing in start process) before the first actual position of the displaceable stop 1 can be stored. It is advisable thereafter to limit regulation in the starting phase, for example by activation of an integrator setting with simultaneous blocking of the proportional amplifier 9*b* over the lines 45 and 45*a*, because the control system would otherwise open the throttle too wide by means of the rescue function. Furthermore, it is important for the starting operation that the influencing of the integrator should preferably be performed while taking account of motor temperature, so that by this precaution a smooth transition into idling speed regulation may be possible. There is accordingly provided in the conventional comprise a NTC resistor in suitable heat conducting contact with portions of the motor, for example the cooling water. This sensor provides to the integrating amplifier 9*a* either through the start recognition circuit 20 or directly, in any case when permitted by the start recognition circuit 20**, a complementary motor temperature signal (this is not shown in the drawing) and thus has the effect that a smooth transition idling speed control takes place. The bringing into account of the engine temperature can also be maintained during regulation by means of a time function and only gradually tapered off. A further advantageous possibility for temperature-dependent influencing of the system is offered by control of stop position or of the integrator content with reference to speed in a manner dependent upon engine temperature in accordance with some particular function determined, for example, by experiment with the particular engine type.

The Zener diode 49 provided in the connection 34 of the speed signal to the comparison stage 32 of the integrator control circuit serves for limiting the signal here supplied to the speed range in $n \leqq n_2$, i.e., to the partial load mode range which precedes the attainment by the engine of the speed boundary $n_2$ which defines entry into the drive mode, the speed boundary $n_2$ being the upper of the two boundaries respectively serving upwards and downwards transitions into and out of the drive mode.

There is still another control operation with reference to the integrating amplifier **9*a* that proceeds from a comparison stage 48 which compares the stored actual position signal $L_i$ of the store 19 with the reference position signal provided by the summing stage 17 of the controller amplifier 9. Because of the output diode 48*a*, this produces a comparison for a lower speed setting. The output signal is also supplied to the summing stage 14** for the integral component, so that it is made certain that this lower speed setting will not be understepped at the integrator.

It is to be understood that the signal provided at the terminal 30 freeing the store 19 for storage of the actual position signal of the stop 1 only in the idling condition can also originate from a transmission or clutch switch, instead of being derived from a tachogenerator What is essential merely that an erroneous storage of the position signal which represents the idling operating point should be prevented.

Further useful developments of the present invention are provided by the possibility of modifying temperature sensitive reference values, for example the reference magnitude $U_{no}$ defining the reference mid-value for idling, which is supplied to the comparison stage 12.

When the engine is cold, a raising of the idling speed region towards higher speeds can be desirable.

Although the invention has been described with reference to a particular illustrative embodiment, it will be understood that modifications and variations are possible within the inventive concept.

We claim:

1. Apparatus for controlling, especially in idling, the speed of a vehicular internal combustion engine having a throttle imposed in an engine intake duct for controlling the engine speed, and an accelerator control for said throttle actuatable by a vehicle driver, comprising:

means for producing a signal representative of actual engine speed;

means for producing a reference idling speed signal;

means for comparing said actual engine speed signal with said reference idling speed signal to produce a first error signal;

means for modifying said first error signal by blocking out any portion thereof corresponding to deviation of actual speed from said reference idling speed which is equal to or less than a predetermined extent of deviation and thereby providing a first modified error signal;

means for modifying said first modified error signal by adding at least one other signal thereto including a signal proportional to said signal representative of engine speed, and thereby producing a second modified error signal;

means including a proportional amplifier of unsymmetrical amplification with respect to error signal sign for processing said first modified error signal;

means including an integrator of unsymmetrical characteristics with respect to error signal sign for processing said second modified error signal;

means for adding together the process signal respectively produced by said processing means and thereby producing a throttle position reference signal;

a displaceable stop for said throttle for defining a condition of said throttle when said accelerator control is not actuated.

means for producing a signal representative of the actual position of said displaceable stop;

means for producing a throttle actuation signal when said throttle is actuated so as to remove it from said displaceable stop;

means for comparing said signal representative of actual position of said displaceable stop with said position reference signal provided by said means for adding the signals produced by said processing means, and thereby producing a final error signal;

means for displacing said stop in accordance with said final error signal;

means for disabling said displacing means responsive to said throttle switch signal, and means for disabling said means for processing said first modified error signal in response to said throttle switch signal.

2. Apparatus according to claim 1, in which said proportional amplifier of said means for processing said first modified error signal is equipped with supplementary means for supplementing the output of said proportional amplifier with a differential component when the sign of said first modified error signal corresponds to the engine speed being lower than said reference idling speed by a speed deviation greater than said predetermined extent of deviation.

3. Apparatus according to claim 1, in which means are provided responsive to an output of said means for modifying said first error signal to provide said first modified error signal indicative of engine speed exceeding said reference idling speed by more than said predetermined extent of deviation, for interrupting the operation of said proportional amplifier.

4. Apparatus according to claim 1 including means for preloading said integrating amplifier during the presence of said throttle switch signal, said preloading means comprising:

means for comparing the output of said integrating amplifier with a stored signal derived from said means for producing a signal representative of the actual position of said stop and for adding to the result of said comparison a signal proportional to engine speed and supplying the result as an output;

control circuit means arranged to be enabled by the presence of a signal indicative of actuation of said throttle and for producing in response to said output of said last-mentioned comparing means a control output signal formed with reference to the throttel control characteristic of the engine and supplying said control output as a subtraction from the sum produced by said means for modifying said first modified error signal to produce said second modified error signal.

5. Apparatus according to claim 4, including drive condition recognition means having a first and a second output and having an input connected to said means for producing a signal representative of actual engine speed and for providing at said first output a signal indicative of actual engine speed overstepping a predetermined drive on said speed threshold and at said second output a signal indicative of engine speed understepping a drive termination speed threshold lower than said drive on said speed threshold, said apparatus further including means responsive to said first output of said drive mode recognition means for augmenting said position reference signal;

means responsive to said augmented position reference signal or disabling the restoration of said throttle switch signal to the condition representing an unactuated accelerator; and means responsive to said second output of said drive recognition means for interrupting the blocking of said stop displacement means by said throttle switch signal for a predetermined time interval, whereby idling speed regulation is restored.

6. Method of controlling, especially in idling, the speed of a vehicular internal combustion engine having a throttle disposed in an engine intake duct, for controlling engine speed, and an accelerator control for said throttle actuatable by a vehicle driver, said method being automatically operated by means of a displaceable stop for adjusting the idling setting of said throttle during particular conditions of operation of said engine, said method comprising the steps of:

comparing a signal representative of actual engine speed ($U_n$) with a reference idling speed signal ($U_{no}$) to produce a first error signal;

modifying said first error signal by blocking out any portion thereof corresponding to deviation of actual speed from said reference idling speed which is equal to or less than a predetermined extent of deviation to provide a first modified error signal;

modifying said first modified error signal by adding a further contribution thereto including at least a signal proportional to said signal representative of engine speed to produce a second modified error signal;

processing said first modified error signal by a proportional amplifier of unsymmetrical amplification with respect to error signal sign;

processing said second modified error signal by an integrator amplifier of unsymmetrical characteristic with respect to error signal sign;

adding the processed first and second modified first error signals to produce a reference position signal ($L_s$) for said displaceable stop; and comparing a signal ($L_i$) representative of actual position of said displaceable stop with said reference position signal ($L_s$) to produce a final error signal, and displacing said stop in accordance with said final error signal.

7. Method according to claim 6 in which the step of processing said first modified error signal by a proportional amplifier is performed with the provision of a supplementary differential component when the engine speed is lower than said reference idling speed by a speed deviation greater than said predetermined extent of deviation.

8. Method according to claim 6 in which, when the engine speed exceeds said reference idling speed by a speed deviation greater than said predetermined extent of deviation, the processing of said first modified error signal by a proportional amplifier is interrupted so as to limit the production of said reference position signal ($L_s$) for said displaceable stop at first to the result of processing said second modified error signal by an integrating amplifier followed by a gradual return to the reference idling speed represented by said reference idling speed signal.

9. Method according to claim 6 in which engine temperature is measured and at least one reference signal is modified in respect thereto.

10. Method according to claim 6 in which engine temperature is measured and the unsymmetrical amplification or characteristic of an amplifier for processing at least one of said modified first error signals is varied in response to temperature variations.

11. Method according to claim 6 in which when the engine throttle responds to actuation by said acelerator control, a throttle switch signal is provided and in response thereto the step of processing said first modified error signal by a proportional amplifier is interrupted.

12. Method according to claim 11 in which in response to either said throttle switch signal or to said actual speed signal exceeding said reference idling speed signal by more than said predetermined extent of deviation a negative contribution from a control circuit is provided in the modification of said first modified error signal for production of a second modified error signal, said contribution being derived from the result of a comparison of the processed second modified error signal with the processed first modified error signal combined with the addition of a signal proportional to actual engine speed, whereby a prepositioning of said displaceable stop for future transitional guiding back of the engine speed into the idling range is provided, said throttle switch signal also being used to block displacement of said stop.

13. Method according to claim 12 in which after a first "drive" speed threshold is overstepped, the displaceable stop is caused, as the result of application of a drive positioning priority signal augmenting said reference positional position signal ($L_s$) for said displaceable stop, to set a spacing device assuring a gap between it and the throttle switch sufficient to prevent termination of the throttle switch signal, and in which when, during the presence of said throttle switch signal the actual engine speed signal falls from a higher value below a predetermined threshold speed lower than said first "drive" speed threshold, a signal is produced for a predetermined interval to interrupt the blocking of displacement of said stop by said throttle switch signal until movement of said stop permits the throttle switch to terminate said throttle switch signal.

* * * * *